US007426776B2

(12) United States Patent
Love, III et al.

(10) Patent No.: US 7,426,776 B2
(45) Date of Patent: Sep. 23, 2008

(54) NONWOVEN TOWEL WITH MICROSPONGES

(75) Inventors: Franklin Sadler Love, III, Columbus, NC (US); Terry S. Taylor, Inman, SC (US); Randy G. Meeks, LaGrange, GA (US); Joseph L. Alexander, Boiling Springs, SC (US); Karen H. Stavrakas, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 56 days.

(21) Appl. No.: 11/703,378

(22) Filed: Feb. 7, 2007

(65) Prior Publication Data

US 2008/0188155 A1 Aug. 7, 2008

(51) Int. Cl.
*D04H 1/46* (2006.01)
*D04H 1/52* (2006.01)

(52) U.S. Cl. ..... 28/167; 28/104; 28/106

(58) Field of Classification Search ..... 28/104, 28/105, 106, 167, 103; 112/475.01, 402, 112/420, 437; 442/366, 408; 156/148
See application file for complete search history.

(56) References Cited

U.S. PATENT DOCUMENTS

| | | | | |
|---|---|---|---|---|
| 2,862,251 A | | 12/1958 | Kalwaites | 264/119 |
| 3,329,552 A | | 7/1967 | Hughes | 112/420 |
| 3,485,706 A | | 12/1969 | Evans | 428/134 |
| 3,508,308 A | * | 4/1970 | Bunting, Jr. et al. | 28/104 |
| 3,750,236 A | | 8/1973 | Kalwaites | 28/104 |
| 4,426,414 A | * | 1/1984 | Wilkerson | 112/420 |
| 4,465,726 A | * | 8/1984 | Holmes et al. | 28/105 |
| 4,631,933 A | | 12/1986 | Carey et al. | 66/192 |

(Continued)

FOREIGN PATENT DOCUMENTS

| | | |
|---|---|---|
| DE | 10 2004 027802 | 1/2006 |

(Continued)

OTHER PUBLICATIONS

Patent Cooperation Treaty PCT International Search Report. Date of Mailing, Jun. 13, 2008. International Application No. PCT/US2008/000886.

*Primary Examiner*—Amy B Vanatta
(74) *Attorney, Agent, or Firm*—Cheryl J. Brickey

(57) ABSTRACT

The invention relates to a process of forming a nonwoven fabric with microsponges comprising obtaining a nonwoven base comprising fibers having a first side and a second side and having a weight of greater than about 2 oz/yd$^2$, stitching the nonwoven base with a stitching yarn in elongated spaced apart rows of stitches, the rows of stitching having a stitch shape factor greater than 0.54 wherein the stitching yarn has a tenacity greater than 1 gf/denier. Next, a plurality of microsponges is formed by impinging the first side of the stitched nonwoven fabric with a collimated fluid stream with from about 100 to 200 joules per gram while supporting the stitched nonwoven fabric on a supporting member having areas impervious to the collimated fluid and pores in the supporting member which are pervious to the collimated fluid. The pores of the supporting member have a pore shape factor value of at least the stitch shape factor value of the rows of stitches and the ratio of the distance between the rows of stitches to the average width of the pores is from about 3:2 to 5:2. Also disclosed are the product made by the process and the article.

11 Claims, 8 Drawing Sheets

U.S. PATENT DOCUMENTS

| | | | | |
|---|---|---|---|---|
| 4,868,958 | A | 9/1989 | Suzuki et al. | 28/104 |
| 4,876,128 | A * | 10/1989 | Zafiroglu | 28/167 |
| 5,174,228 | A * | 12/1992 | Grimnes | 112/475.01 |
| 5,288,536 | A | 2/1994 | Zafiroglu | 428/102 |
| 5,310,590 | A | 5/1994 | Tochacek et al. | 428/102 |
| 6,361,784 | B1 | 3/2002 | Brennan et al. | 424/402 |
| 6,502,288 | B2 | 1/2003 | Black et al. | 28/104 |
| 6,509,079 | B1 * | 1/2003 | Suehr et al. | 428/113 |
| 6,566,287 | B1 | 5/2003 | Minura et al. | 442/351 |
| 6,692,541 | B2 | 2/2004 | Carlson et al. | 8/499 |
| 6,725,512 | B2 | 4/2004 | Carter | 28/104 |
| 6,735,833 | B2 | 5/2004 | Putnam et al. | 28/104 |
| 6,852,654 | B2 | 2/2005 | Fuller et al. | 442/408 |
| 6,881,288 | B2 * | 4/2005 | Davies et al. | 156/148 |
| 6,926,931 | B2 | 8/2005 | Qashou et al. | 427/394 |
| 7,012,033 | B2 | 3/2006 | Hayes et al. | 442/93 |
| 7,047,606 | B2 | 5/2006 | Rivera et al. | 28/104 |
| 7,069,629 | B2 | 7/2006 | Burgess et al. | 28/104 |
| 2004/0106348 | A1 | 6/2004 | Casstevens et al. | 442/408 |
| 2005/0095403 | A1 | 5/2005 | Noelle | 428/171 |
| 2006/0182928 | A1 | 8/2006 | Carter et al. | 428/131 |
| 2006/0277731 | A1 * | 12/2006 | Schreiber et al. | 28/271 |
| 2007/0128411 | A1 * | 6/2007 | Kawai et al. | 28/104 |

FOREIGN PATENT DOCUMENTS

| | | |
|---|---|---|
| DE | 10 2006 006358 | 8/2007 |
| DE | 10 2006 006405 | 8/2007 |
| EP | 0 243 163 | 10/1987 |
| WO | WO 2004 090214 | 10/2004 |

* cited by examiner

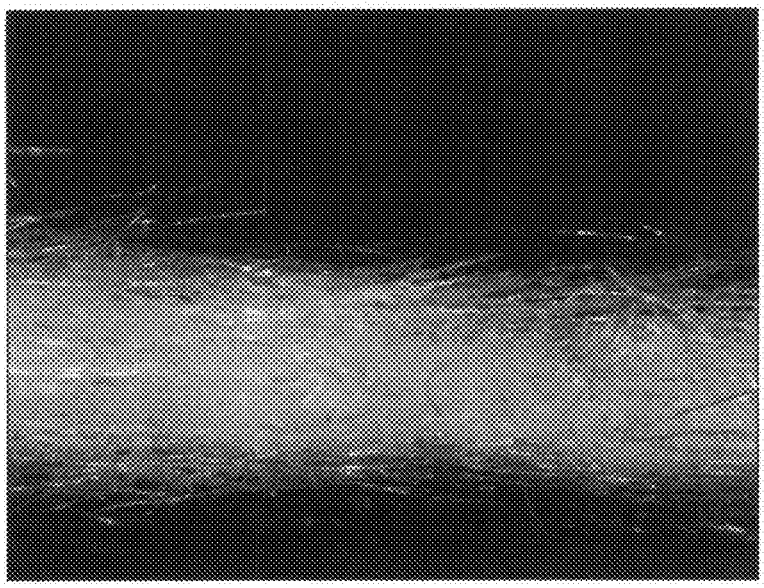
FIG. —1—
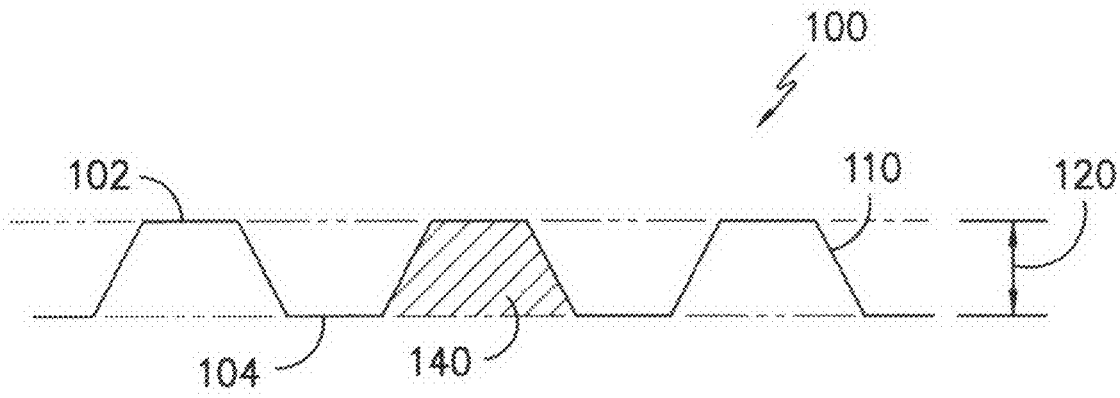
FIG. —2—

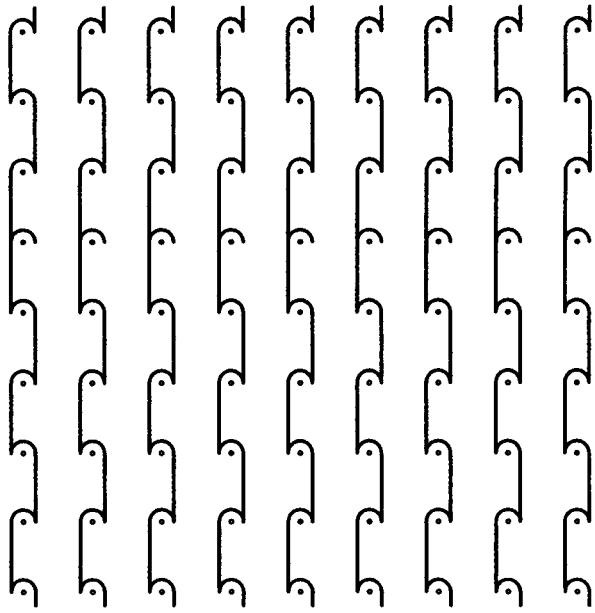
FIG. –5–
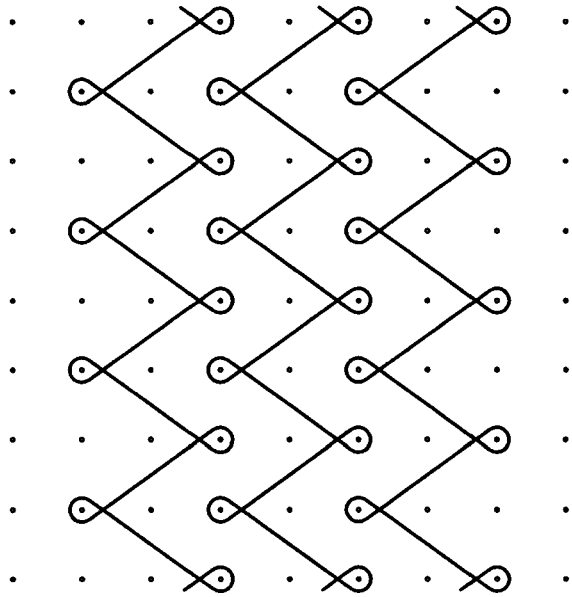
FIG. –6–

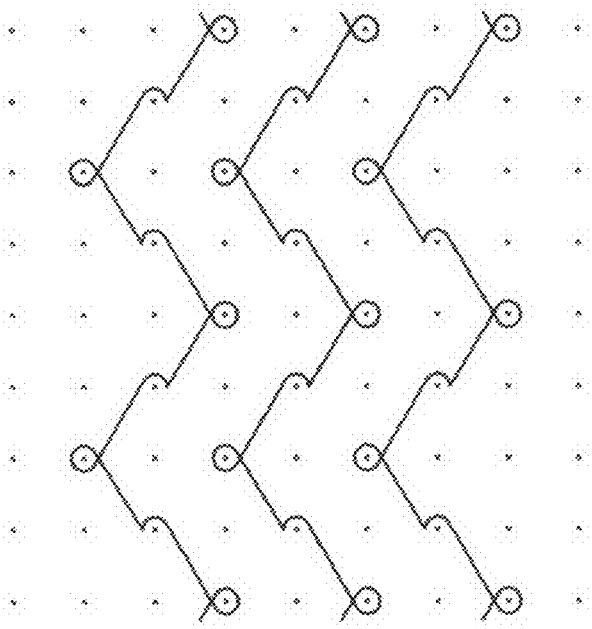
FIG. —7—
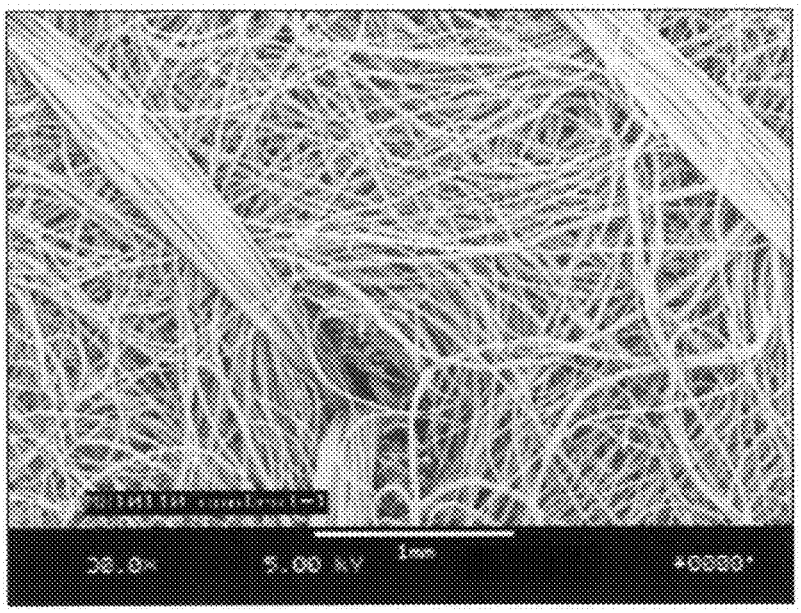
FIG. —8—

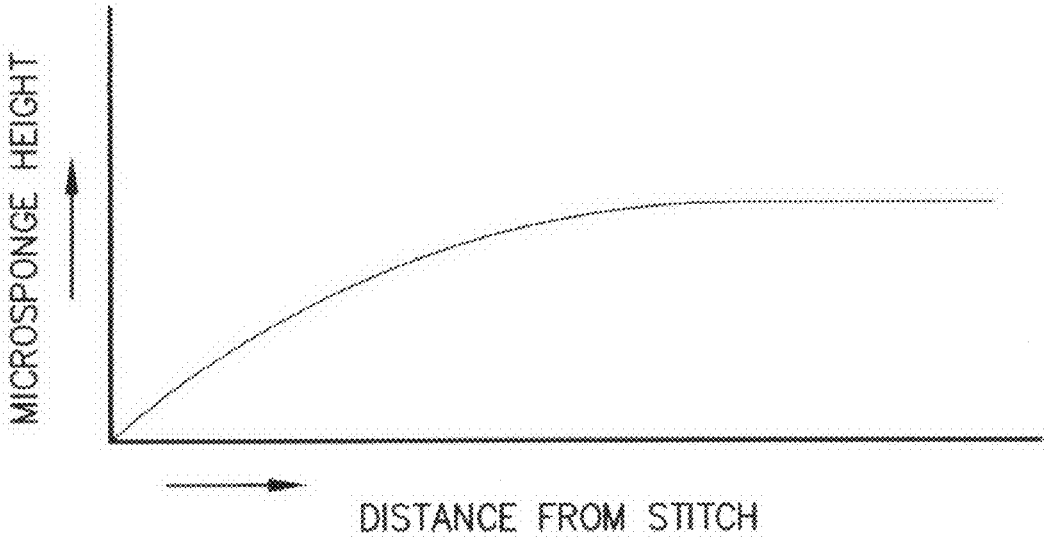
FIG. —9—
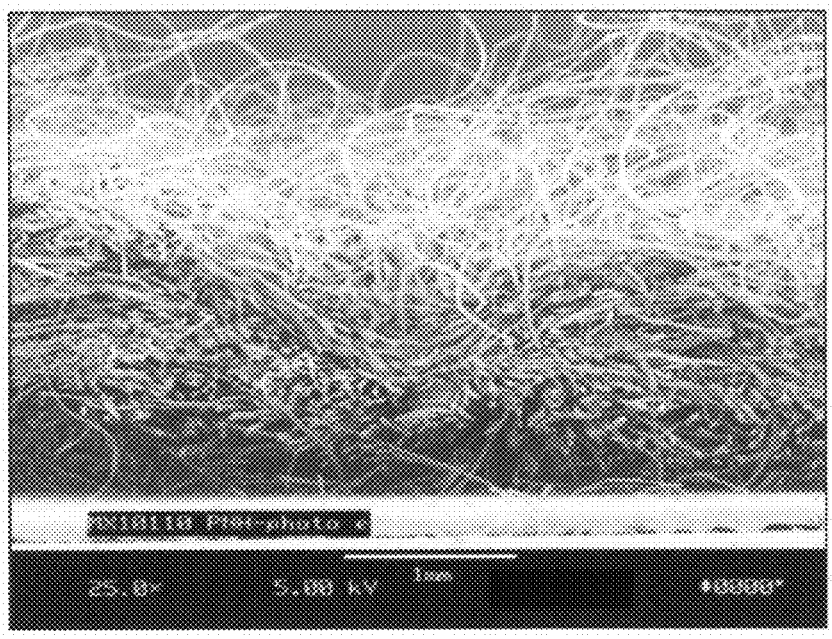
FIG. —10—

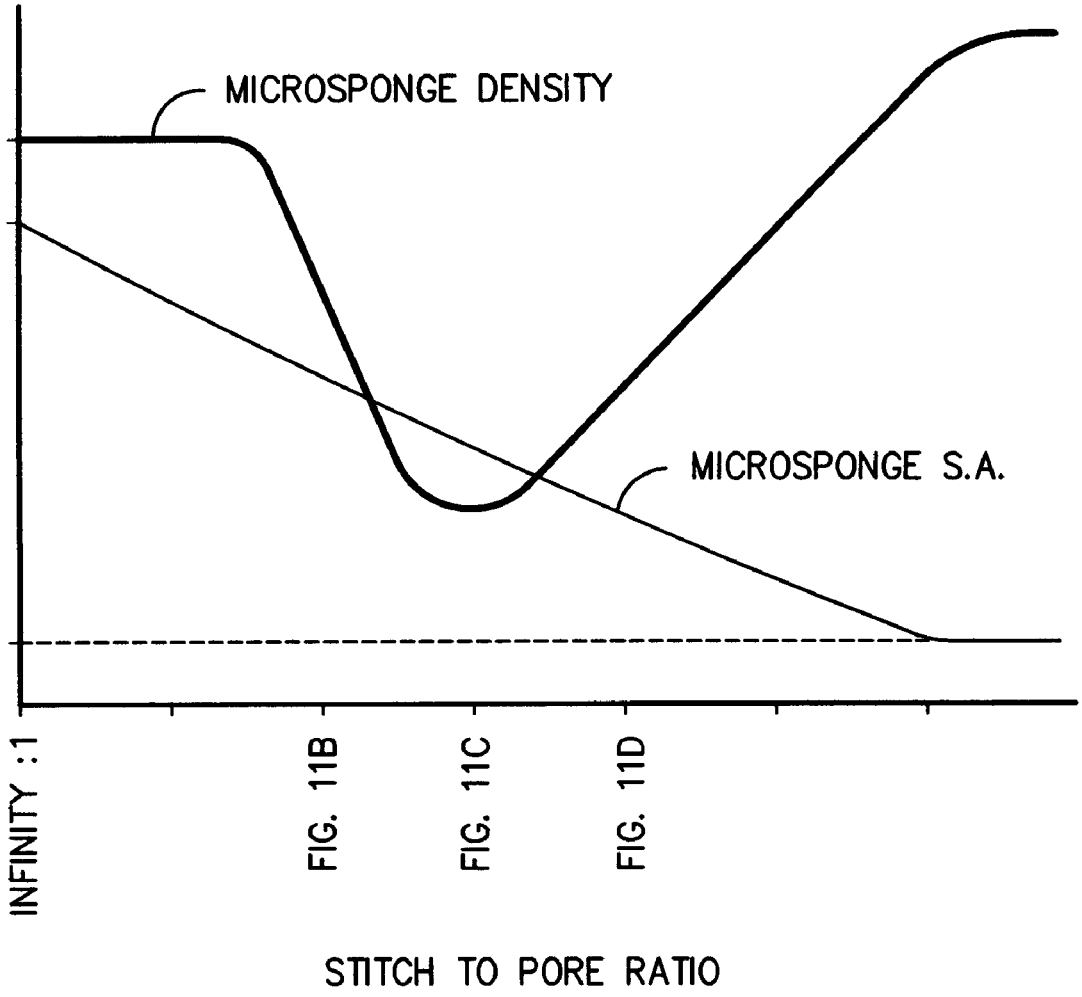
*FIG. –12–*

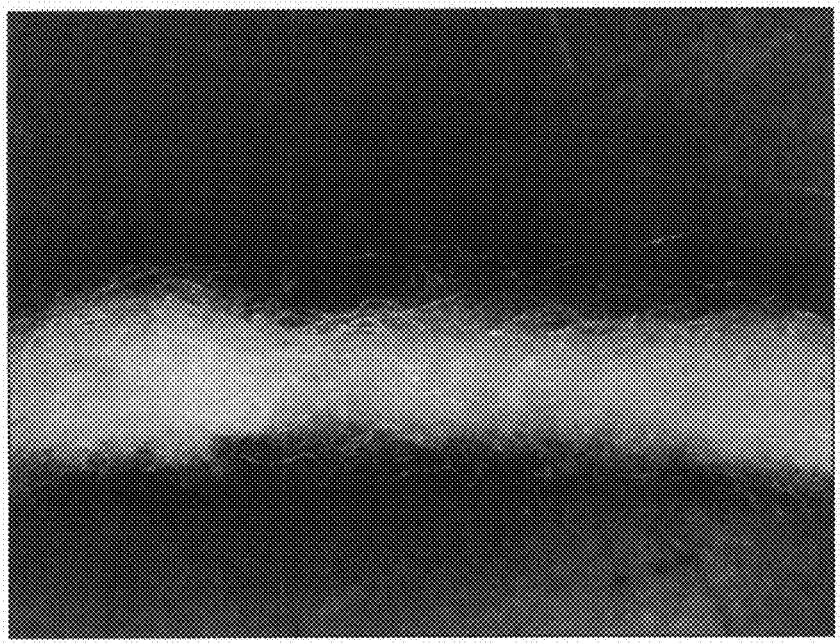
FIG. –13–
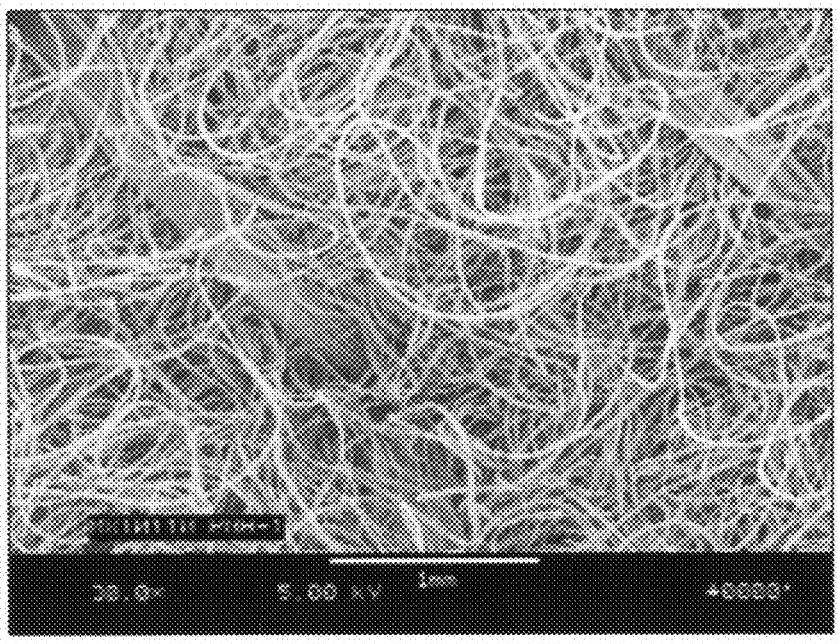
FIG. –14–

NONWOVEN TOWEL WITH MICROSPONGES

TECHNICAL FIELD

This invention relates generally to nonwoven fabric with microsponges for cleaning applications. Methods for forming nonwoven towels with microsponges also are provided.

BACKGROUND

In an industrial laundry industry, cotton towels are laundered and rented to customers for the cleaning of kitchens, tables, walls, bar tops and a host of other miscellaneous duties. The range of uses for the towels creates an environment where the product is subjected to much abuse. These towels are not ideal for all of these applications because of a lack of strength, propensity to lint, poor dimensional stability and susceptibility to degradation from chlorine bleach. Also, industrial laundries must bleach the towels heavily in the wash cycle to remove the tremendous loading of stains, grease, and particulate from the towels. For these reasons, the towels have a very short life span and a longer life would be more desirable.

In order to increase durability and product lifetime, nonwoven absorbent towels have been made from synthetic materials more durable than cotton. When a more durable synthetic material is used the towel absorbency is typically sacrificed.

There is a need for a nonwoven fabric with absorbency and wring-ability equal to or greater than a cotton towel, with high durability, and with long lifetime by creating a plurality of highly absorbent micro-sponges on the surface of the fabric. All patents and patent applicants cited are incorporated by reference in their entirety.

SUMMARY

The present invention provides advantages and/or alternatives over the prior art by providing a nonwoven towel with microsponges formed by obtaining a nonwoven base comprising fibers having a first side and a second side and having a weight of greater than about 2 oz/yd$^2$, stitching the nonwoven base with a stitching yarn in elongated spaced apart rows of stitches to form a stitched nonwoven fabric, the rows of stitching having a stitch shape factor of greater than 0.54, wherein the stitching yarn has a tenacity greater than 1 gf/denier. Next, a plurality of microsponges is formed by impinging the first side of the stitched nonwoven fabric with a collimated fluid stream with from about 100 to 200 joules per gram while supporting the stitched nonwoven fabric on a supporting member having areas impervious to the collimated fluid stream and pores in the supporting member which are pervious to the collimated fluid stream. The pores of the supporting member have a pore shape factor of at least the stitch shape factor of the rows of stitches and the ratio of the distance between the rows of stitches to the average width of the pores is from about 3:2 to 5:2. Also disclosed are the product made by the process and the article. The nonwoven towel with microsponges is also described and claimed.

BRIEF DESCRIPTION OF THE DRAWINGS

The present invention will now be described by way of example only, with reference to the accompanying drawings which constitute a part of the specification herein and in which:

FIG. 1 is an optical microscope cross-sectional view of a nonwoven base of the invention.

FIG. 2 is a schematic of a stitch pattern.

FIGS. 3-7 are schematic illustration of various stitching patterns.

FIG. 8 is a top view by a scanning electron microscope of a stitched nonwoven fabric.

FIG. 9 is a graphical representation of microsponge height as a function of distance from a stitch.

FIG. 10 is a cross-sectional view by a scanning electron microscope of an impinged stitched nonwoven fabric with microsponges.

FIG. 12 is a graphical representation of the relationship between stitch to pore ratio and microsponge surface area and density.

FIG. 13 is an optical microscope cross-sectional image of an impinged nonwoven base (without stitches).

FIG. 14 is a top view by a scanning electron microscope of a stitched nonwoven fabric after being impinged.

DETAILED DESCRIPTION

Figure 3:
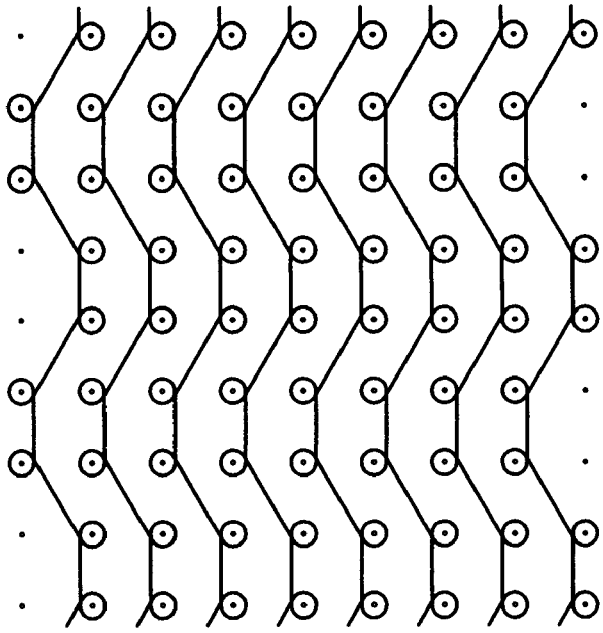

The invention relates to an absorbent nonwoven fabric with a plurality of "microsponges" on one side of an impinged, stitched nonwoven fabric. The microsponges increase the absorbency of the product by increasing the surface area of the nonwoven fabric making available more pathways for liquid absorbance. Additionally, the nonwoven fabric with microsponges has areas of decreased fiber density in the microsponges, meaning that the distance between fibers of the nonwoven fabric have been increased allowing the nonwoven fabric to retain more liquid. The microsponges also decrease contact area between the fabric and the surface to be cleaned, which increases the friction resulting in better wiping.

The process for forming a nonwoven fabric with microsponges begins with a nonwoven base comprising fibers having a first side and a second side and having a weight of greater than about 2 oz/yd$^2$ (67.8 g/m$^2$). In one embodiment, the nonwoven base has a weight of between about 2 and 16 oz/yd$^2$, more preferably about 2 and 8 oz/yd$^2$, more preferably about 4 and 6 oz/yd$^2$. The nonwoven base is preferably substantially nonbonded. FIG. 1 shows a cross-sectional optical photomicrograph image of one embodiment of the nonwoven base formed by carding and crosslapping staple length fibers.

The term "fiber", as used herein, includes staple fibers, continuous filaments, splittable fibers and filaments, and the like. The term "nonwoven fabric or web" means a web having a structure of individual fibers, yarns, or threads which are interlaid, but not in a regular or identifiable manner as in a knitted fabric. Nonwoven bases or webs can be formed from many processes such as, for example, meltblowing processes, spunbonding processes, air laying processes, and bonded carded web processes. Carded and needle punched nonwoven bases are preferred for their good mechanical strength of webs produced. The nonwoven base may also have an additional needling or hydroentangling step. As used herein, the term "substantially nonbonded" means that the fibers of the layer generally are not bonded to each other, as for example by chemical, adhesive or thermal means. "About" and "approximately", in this.

The fibers may be any fiber suitable for a nonwoven towel including natural or synthetic (man-made) fibers. In one embodiment, the fibers comprise synthetic fibers, preferably synthetic fibers that are resistant to chlorine bleach. Many natural fibers have good absorbency, but degrade in chlorine, limiting their useful life span as a commercial reusable cleaning towel. In one embodiment, the nonwoven towels of the invention will be exposed to high heat when used as a cleaning product in kitchens around ovens and grills, therefore in that embodiment; the fibers preferably have a melting temperature of at least 420° F. Polyester and its co-polymers are particularly suited due to a high melting point versus other synthetics such as polypropylene. Polyethylene terephthalate (PET) is readily available, low cost and can be made hydrophilic with chemical modification. Other man made fibers include, but are not limited to, polytrimethylene terephthalate (PTT), polycyclohexane dimethylene terephthalate (PCT), polybutylene terephthalate (PBT), PET modified with polyethylene glycol (PEG), polylactic acid (PLA), polytrimethylene terephthalate, nylons (including nylon 6 and nylon 6,6); regenerated cellulosics (such as rayon or Tencel); elastomeric materials such as spandex; and high-performance fibers such as the polyaramids, and polyimides. In another embodiment, the nonwoven base fibers comprise natural fibers such as cotton, linen, ramie, and hemp, proteinaceous materials such as silk, wool, and other animal hairs such as angora, alpaca, and vicuna, or a mixture of natural and man-made fibers.

Preferably, the fibers of the nonwoven base are staple fibers. In one embodiment, the average staple length of the fibers is between about 3 and 6 inches (7.6 and 16.2 cm) This range has been found to create a nonwoven base that is less susceptible to linting, pilling and wear. In another embodiment, the fibers of the nonwoven base comprise continuous filaments.

In one embodiment, the nonwoven base fibers comprise fibers with a round cross-sectional shape. The round shape has a low bending modulus which adds to the good hand and drape.

In another embodiment, the nonwoven base fibers comprise multi-segment, splittable fibers that may be staple or filament. The term "multi-segment splittable fibers" refers to multi-component fibers, which split lengthwise into finer filaments or fibers of the individual thermoplastic polymer segments when subjected to a stimulus. In one embodiment, this stimulus is mechanical, but other stimuli such as chemicals may be employed. The staple filaments contain at least two incompatible polymers arranged in distinct segments across the cross-section of each staple filament. The incompatible components are continuous along the length of each fiber. The individual components of each fiber split apart from each other when the fiber is subjected to a stimulus, resulting in finer individual fibers formed from the segments.

The splittable fiber is made up of at least a first component and a second component. The first component preferably is a polyester or polyester co-polymer component, including but not limited to PET, PTT, PCT, PBT, PET modified with PEG, and PLA. The second component preferably is a polyamide component or a polyester or polyester co-polymer that is incompatible with the polyester or polyester co-polymer in the first component. The polyester or polyester co-polymer may be, but is not limited to PTT, PCT, PBT, PET, and PET modified with PEG. The polyamide may be, but is not limited to nylon and the polyesters or co-polymers above as long as they are incompatible with first polyester component in such a way as they will split. Nylon is preferred in some embodiments due to increased tenacity, high moisture regain, and natural affinity for water. The first component and second component are desirably in a weight ratio of between 40:60 and 80:20. For maximum productivity, a roughly 50:50 ratio is generally preferred. Both the first and second components of the splittable fibers preferably have a denier of between 0.05 and 0.5, more preferably between 0.15 and 0.5.

In one preferred embodiment, the nonwoven base fibers contain a mixture of staple length splittable fibers and staple length round fibers. In one embodiment, the nonwoven base comprises about 40 to 75% by weight of a staple fiber and about 25 to 50% by weight of a splittable fiber; more preferably, about 65 to 75% by weight a staple fiber and about 25 to 35% by weight a splittable fiber. More details about preferred compositions of the nonwoven base may be found in commonly owned co-pending application Ser. No. 11/436,865, entitled "Nonwoven Fabric Towel" by Greer et al. hereby incorporated by reference.

Preferably, at least some of the fibers are treated with a hydrophilic surface treatment. Preferably, the hydrophilic surface treatment is durable. In this application "durable" is defined to be that the hydrophilic surface treatment is still on the fibers in an amount of at least 200 ppm by weight of fibers after 30 industrial washes. For purposes of these tests, the term "industrial washes" is intended to describe the wash process described as follows. All washings were performed according to the following wash method: Fabrics were washed in a conventional industrial washer at 80% capacity for 12 minutes at 140° F., using the low water level and 8.0 oz of Choice chemical, which is commercially available from Washing Systems, Inc. of Cincinnati, Ohio. The washing cycle was performed as follows: drop/fill/wash for 3 minutes at 140° F., low level water using 7.5 oz of Choice chemical; drop/fill/rinse for 2 minutes at 140° F., high level water, no chemical; drop/fill/rinse for 2 minutes at 80° F., high level water, no chemical; drop/fill/rinse for 2 minutes at 80° F., high level water, no chemical; drop/fill/wash for 4 minutes at 80° F., low level water using 0.3 oz acid sour; Extract water for 7 minutes at high speed. The fabrics were then dried.

This treatment may be applied during the manufacture of the fibers, applied to the fibers, or applied to the finished towel. The hydrophilic agents may be applied by spraying, foam coating, dye jetting, padding, applying during yarn formation, or included in the yarn formation. In one embodiment, the hydrophilic agent is in the collimated fluid impinging the stitched nonwoven fabric.

The term "hydrophilic" as used herein indicates affinity for water. The hydrophilicity of the hydrophilic component polymer can be measured in accordance with the ASTM D724-89 contact angle testing procedure on a film produced by melt casting the polymer at the temperature of the spin pack that is used to produce the conjugate fibers. Desirably, the hydrophilic polymer component has an initial contact angle less than about 90 degrees, more desirably equal to or less than about 75 degrees, even more desirably equal to or less than about 60 degrees, most desirably equal to or less than about 50 degrees. The term "initial contact angle" as used herein indicates a contact angle measurement made within about 5 seconds of the application of water drops on a test film specimen.

In one embodiment, the fibers or nonwoven base fabric may be treated with a hydrophilic agent such as an anionic-ethoxylated sulfonated polyester (AESP, surfactant/stabilizer agent) and a high molecular weight ethoxylated polyester (HMWEP, lubricant/softener agent). This treatment allows the fabric to absorb water very rapidly and promotes wicking, water transport, and dissipation through the fabric, and liquid retention, with the result being that the surface of the fabric quickly feels dry to the touch. The treatment also helps to prevent staining, improves washing performance and reduces creasing. In some embodiments, the hydrophilic treatment is a hydrophilic lubricant, meaning that in addition to providing a hydrophilic nature to the fibers, it also provides lubrication.

AESP and HMWEP are examples of hydrophilic lubricants. While not being bound by any particular theory, it is believed that the addition of a hydrophilic lubricant may aid in the formation of microsponges because it allows the fibers to move more easily past one another into the microsponge.

Other hydrophilic treatments include: non-ionic soil release agents having oxyethylene hydrophiles, such as the condensation polymers of polyethylene glycol and/or ethylene oxide addition products of acids, amines, phenols and alcohols which may be monofunctional or polyfunctional, together with binder molecules capable of reacting with the hydroxyl groups of compounds with a poly(oxyalkylene) chain, such as organic acids and esters, isocyanates, compounds with N-methyl and N-methoxy groups, bisepoxides, etc. Particularly useful are the condensation products of dimethyl terephthalate, ethylene glycol and polyethylene glycol (ethoxylated polyester) and ethoxylated polyamides, especially ethoxylated polyesters and polyamides having a molecular weight of at least 500, as well as soil release agents described in the following patents. Additional hydrophilic treatments may be found in U.S. Pat. No. 7,012,033, incorporated herein by reference.

Once the nonwoven base is formed, the nonwoven base is stitched with a stitching yarn in elongated spaced apart rows of stitches to form a stitched nonwoven fabric. In one embodiment, the rows extend generally in the lengthwise (or machine) direction. The stitching may be done on any suitable stitching machine, including but not limited to, a sewing machine or a knitting machine. Because of the way the stitching is created there are necessary "crossovers" of the stitches on one side, that the "face" of the fabric will have a different stitch pattern from the "back". The shape and size of the microsponges formed will be different depending on which side is impinged with the high pressure fluid. It has been found that the stitch pattern on the side opposite the side that is impinged determines the shape and size of the microsponges, and that therefore this side that is opposite the impingement is used as the "face" or first side of the nonwoven fabric with regards to the microsponges. One primary function of the stitching is to add dimensional stability to the nonwoven web and to provide bounded areas through which the nonwoven fibers are pushed through to form the microsponges. This dimensional stability is believed to play an important role in the durability of the product. It has been found that a non-stitched base would degrade much faster due to the mechanical stresses applied during normal use and washing and drying and would suffer from material loss, reduced performance, and a shorter lifetime.

In addition to serving the purpose of adding mechanical stability to the nonwoven fabric, the rows of stitches also provide the substrate for microsponge formation. As energy is applied by the collimated fluid, the fibers from the nonwoven fabric are either pushed outward and away from the base fabric or held in place by the stitching. Fibers from the nonwoven fabric that lie beneath or adjacent to the stitching are pinned down and are not allowed or only partially allowed to be pushed outward. The maximum height of microsponges is achieved at points on the nonwoven fabric that are furthest away from the stitches. Fibers adjacent to the stitches are held back to some degree depending on their distance from the stitch. The microsponges formed tend to be tighter and tougher at the periphery as they are bound and constrained by the stitches. This leads to a more durable surface effect and at the same time a very absorptive microsponge. As the distance that any one fiber lies from the stitch increases, the extent to which it is pushed outward by the force of the water jet increases as shown in FIG. 9. The areas at the midpoint between the rows of stitches have a density of the between about 10 and 90%, more preferably 25 and 75%, more preferably about 50% less than in the areas of the rows of stitches.

Since the amount of water that can be absorbed by each microsponge depends on microsponge volume (the amount of three dimensional space that the microsponge occupies) and the height of the microsponge is a contributing aspect of volume, then it is important to maximize the height to which each fiber in the non woven web is allowed to be pushed outward. Therefore, the stitch pattern controls the average distance that any one fiber is spaced from the stitch that surrounds it and this should be maximized. Furthermore, since the only curve that maximizes the area that it encloses under isoperimetric conditions is a circle, the average distance that any one fiber is spaced from the stitch is maximized when the shape of the stitch is a circle. Therefore, the degree to which the area that a stitch encloses approaches the area of a circle with a perimeter equal to that of the stitch shape must be maximized. The degree to which the area that a stitch encloses approaches the area of a circle with a perimeter equal to that of the stitch shape is quantified by a "stitch shape factor".

The rows of stitches have a stitching pattern with a stitch shape factor of greater than 0.54, more preferably greater than 0.6, more preferably greater than 0.65. The term "stitch shape" in the phrase "Stitch shape factor" in terms of the stitching pattern for this application is defined to be the area bounded by the stitch and stitch width (shown as area 140 in FIG. 2). The phrase "Stitch shape factor" in terms of the stitching pattern for this application is defined to be the dividend of the area bounded by the stitch and the stitch width and the area of a circle that is isoperimetric to the area bounded by the stitch and the stitch width. The term isoperimetric in terms of the stitch shape factor for this application refers to a circle with the same perimeter length as the area bounded by the stitch and the stitch width. For clarity, how the stitch shape factor is measured is illustrated in FIG. 2. FIG. 3 shows the same stitch pattern as shown in FIG. 2 (a stitching pattern of 1-0/1-0, 1-2/1-2) but in an alternative format. The stitch pattern 100 of FIG. 2 has a right most element 102 and a left most element 104 that defines the width of the stitch 120. The stitch yarn 110 and the width of the stitch 120 define the area bounded by the width of the stitch and the stitching yarn 140. The stitch shape factor of the area 140 is defined by the following equation is the stitch shape factor of the stitch pattern:

$$SSF = \frac{Area_{stitch\ shape}}{Area_{circle}},\ Area_{circle} = \pi\left(\frac{P}{2\pi}\right)^2$$

where, "SSF"=Stitch Shape Factor, "$Area_{stitch\ shape}$"=the area of the stitch shape, "$Area_{circle}$"=the area of a circle with a perimeter length equal to the stitch shape, "P"=perimeter length of the stitch shape.

For a circle pattern, the stitch shape factor would be 1. For a straight line formed, for example, by a straight chain stitch that encloses no area, the stitch shape factor would be 0. For the half hexagon shaped area 140, the stitch shape factor is 0.75 as shown by the following equation:

$$SSF = \frac{0.3375\,\text{in}^2}{\pi\left(\frac{0.75}{2\pi}\right)^2\,\text{in}^2} = 0.754$$

A "pore shape factor (PSF)" and "microsponge shape factor" is calculated in the same manner as the stitch shape factor, except the area and dimensions of the pore or the microsponge is used versus the area bounded by the stitch and stitch width.

Figure 4:
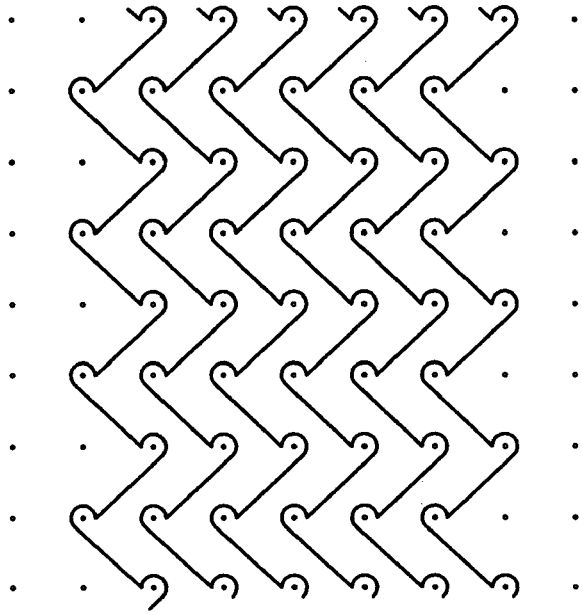

The stitch shape factor of stitch pattern 100 shown in FIG. 2 is 0.75. FIGS. 4-7 show alternative stitch patterns. The stitching pattern of FIG. 4 is a 0-1/2-1 tricot open single bar stitch and has a stitch shape factor of 0.54. FIG. 5 is a 0-1/1-0 chain stitch that does not enclose any area and has a stitch shape factor of 0.0. FIG. 6 is a 1-0/2-3 atlas 3 needle stitch pattern with a stitch shape factor of 0.60. The stitches shown in FIGS. 4-5 have a stitch shape factor of significantly less than 0.55 meaning that they are not shaped adequately to produce microsponges and therefore would not have the physical properties desired for the nonwoven fabric. FIG. 7 shows a stitch pattern (0-1/1-2, 2-3/2-1) with a stitch shape factor of 0.54 which would not result in microsponges. FIG. 8 shows a scanning electron microscope image taken at 30× of the nonwoven base with stitches.

The stitching yarn has tenacity greater than 1-8 gf/denier, more preferably 1.5-2.5 gf/denier, and is preferably a continuous filament having a denier of between about 50 and 300. Preferably, the stitching yarn has shrinkage of between about 0 and 4% when subjected to 320° F. for 30 sec. The stitching course count is typically in the range of about 2 to 15 stitches per cm, in one embodiment 2 to 10 stitches per cm.

The means of creating the microsponge is non-trivial in that the right balance between fabric characteristics and processing conditions must be found in order to create a nonwoven fabric with the desired characteristics. These characteristics and processing conditions include fabric weight, stitch pattern, stitching gauge, stitching course count, pore geometry and size of supporting porous substrate, fluid stream type size, and pressure, and processing speed. These conditions are optimized for high absorbance, desirable hand, good wipe-ability, good wring-ability, woven-like appearance, low shrinkage during heatsetting, low shrinkage during wash/dry process, low linting level, permanence of microsponge, and low weight loss due to normal use and wash/dry process.

The plurality of microsponges are formed by impinging the first side of the stitched nonwoven fabric with a collimated fluid stream with from about 100 to 200 joules per gram of energy, more preferably 115 to 175 joules per gram, while supporting the stitched nonwoven fabric on a supporting member having areas impervious to the collimated fluid and pores in the supporting member which are pervious to the collimated fluid (with ample volume below the supporting member to allow water to escape). Preferably, at least 80% of the area of the supporting member comprises pervious areas. Microsponge formation relies on the ability of the fibers in the nonwoven fabric to move away from the main body of the web, through the bounded areas formed by the stitching, and into the pores of the supporting substrate. A cross-sectional scanning electron microscope image of the impinged, stitched nonwoven fabric may be seen in FIG. 10.

In one embodiment, the impinging collimated fluid comprises water, more preferably a jet of high pressure (1000-1500 psi) room temperature water and preferably containing a hydrophilic lubricant. The high pressure water jet pushes the fibers on the second side of the stitched nonwoven fabric away from the nonwoven fabric and into the pores of the supporting member and deposits the hydrophilic lubricant onto the fabric. The shape and cross sectional size of the protruding microsponges created are determined by the size and shape of the pore openings on the supporting member, the size and shape of the rows of stitches, position of the rows of stitches with respect to the pore, and the energy applied by the collimated fluid. In one embodiment, particularly when running in a continuous type operation, the collimated fluid is angled in such a way so as to impinge the stitched nonwoven fabric such that the impinging fluid assists in the movement of the fabric web. This serves to lessen the tension in the fabric as it moves over the supporting member. Typical angles are +1-10 degrees with respect to a line drawn normal to the fabric. The + sign indicates that the collimated fluid is angled so as to push the fabric along its normal path of movement in a continuous operation.

The function of the supporting member is to create pores as openings for the fibers that are allowed to expand around the rows of stitches from the stitched nonwoven fabric to expand into upon treatment of the high pressure water jet, and to allow the water to escape without interfering with the formation of the microsponges. The preferred pore shape has a pore shape factor that is at least equal to the stitch shape factor of the shape formed by the rows of stitches so that the fibers in the nonwoven base that are being pushed around the rows of stitches have sufficient area to expand. This expansion will create a three dimensional protruding microsponge from the nonwoven web exhibiting the maximum amount of microsponge surface area for the particular stitch and pore factor being employed. Since the height of the microsponge increases as the distance from the rows of stitches increases, it is preferred that the stitch and pore shape factor approach unity so that the microsponges occupy as much volume as possible. Microsponge height and volume are limited by the stitch shape factor of the rows of stitches being employed. Maximum microsponge height and volume are achieved at a stitch shape factor of unity. As the stitch shape factor of the rows of stitching approaches unity, the stitch shape approaches that of a perfect circle and the number of stitching courses that must be stitched into the nonwoven base to form the circular shape approaches infinity. In one embodiment, the pores have a hexagonal shape. In another embodiment, the pores have an average width of between 2 and 10 millimeters.

In addition to stitch shape and pore shape, another important aspect of the invention is the stitch to pore ratio. The stitch to pore ratio is defined as the ratio between the width of equally spaced rows of stitches and the width from pore to pore on the substrate supporting the stitched nonwoven fabric during treatment by the collimated jets. This ratio is important because it affects the surface area and density that the microsponge achieves during treatment by the collimated jets. Since higher absorbance is achieved by microsponges with high surface area and low density, a stitch to pore ratio must be chosen that takes these two factors into consideration.

Figure 11A:
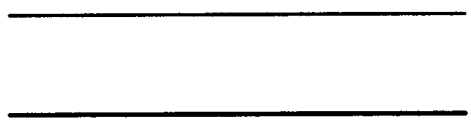
FIGS. 11A-D are schematic representations of profiles of the nonwoven fabric with different stitch to pore ratios.
Figure 11B:
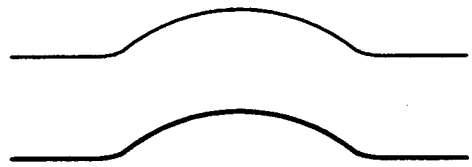

FIGS. 11A-D show profile views of several microsponges formed under three different stitch to pore ratios. FIG. 11A is the profile view of the nonwoven fabric before treatment of the collimated jet where the nonwoven fabric has a density that is representative of the density of the untreated nonwoven fabric and has a surface area that is representative of the surface area of the untreated nonwoven fabric. FIG. 11B is the profile view of a microsponge formed with a stitch to pore ratio that is less than about 3:2. In this case, because there is no stitch positioned on the nonwoven fabric located in the middle of the pore of the supporting substrate, the entire body of the nonwoven fabric is pushed into the pore such that the density of the resulting microsponge has not decreased, but the surface area has increased with respect to the untreated case of FIG. 11A. In this case, no microsponges are formed.

Figure 11C:
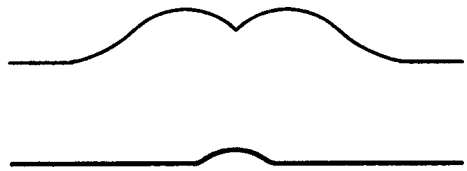

FIG. 11C shows a profile view of a microsponge with a stitch to pore ratio of about 2:1. In this case, there is always a row of stitches positioned in the nonwoven fabric in the area of each pore of the supporting substrate so that the entire body of the nonwoven fabric is not pushed into the pore. In this configuration, the surface area increases and the density of the fabric decreases with respect to the untreated fabric of FIG. 11A. Microsponges are formed by the conditions in FIG. 11C.

Figure 11D:
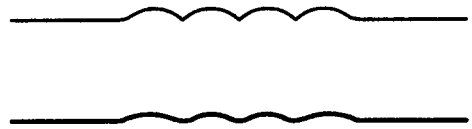

FIG. 11D is the profile view of a microsponge formed with a stitch to pore ratio of greater than about 5:2. In this case, two or more stitches lie in the nonwoven fabric in the middle of the pore. When impinged, the stitches pin down and prevent the fibers from being pushed outward resulting in very little change in the density or surface area compared to the untreated case of FIG. 11A. Microsponges are not formed by the conditions in FIG. 11D. A summary of the density, surface area, and microsponge formation for FIGS. 11B-D are shown in FIG. 1.

TABLE 1

Comparison of stitch:pore ratios on microsponge formation

| | Density of fabric as compared to FIG. 11A | Surface area of fabric as compared to FIG. 11A | Microsponges formed? |
|---|---|---|---|
| FIG. 11B | About same | Increases | No |
| FIG. 11C | Decreases | Increases | Yes |
| FIG. 11D | About same | About same | No |

The trend described above is also plotted in FIG. 12. Microsponge density is constant at a level until a stitch to pore ratio of approximately 3:2 is reached where the density begins to drop to a minimum point, at a stitch to pore ratio of about 2:1. The microsponge density than increases in all stitch to pore ratios greater than about 2:1. The far left point on the graph represents a fabric with no rows of stitching (or infinity: 1 ratio). The surface area begins at this value and as stitches are added to the nonwoven fabric, the surface area of the microsponge formed decreases constantly until surface area reaches a minimum plateau level. This plateau level is the surface area of a nonwoven fabric untreated by the collimated jets. Therefore, the preferred ratio of the average distance between the rows of stitches to the average width of the pores is from about 3:2 to 5:2, more preferably approximately 2:1.

Impinging a nonwoven base (without the rows of stitches) does not result in the formation of microsponges as can be seen from FIG. 13). The microsponges that result on the second side of the nonwoven fabric from impinging the stitched nonwoven fabric are a combination of the support surface pore geometry and the stitch pattern in the fabric. In one embodiment, the resulting microsponges are an interference pattern formed by the pore shape and pattern and stitch pattern with constructive and destructive regions. The gauge and course count of the stitch can be varied as long as the mechanical stability of the product is not compromised.

The microsponges formed are bound on at least two sides by the rows of stitches and a portion of the fibers on the outer portion of the nonwoven fabric generally follow the surface topography of the microsponges perpendicular to the general direction of the rows of stitches and form striations in the microsponge. This can be seen, for example, in FIG. 10. The first side has an average surface roughness of about 20 to 80 micrometers and the second side with the microsponges has an average surface roughness of about 120 to 500 micrometers. The first side of the fabric does not have an inverse pattern of the microsponges. In another embodiment, the second side of the impinged, stitched nonwoven fabric has a roughness of at least about 3 times greater than the surface roughness of the first side.

Microsponges, as defined in this application are three-dimensional structures on one side of the stitched nonwoven fabric that have a pore shape factor at least equal to the stitch pore factor (greater than 0.54) and is bounded on at least two sides by the rows of stitches. The microsponges formed have a microsponge shape factor of greater than 0.54. A portion of the fibers on the outer portion of the nonwoven base generally follow the surface topography of the microsponges perpendicular to the general direction of the rows of stitches and form striations in the microsponge. The areas at the midpoint between the rows of stitches have a density of the between about 10 and 90%, more preferably 25 and 75%, more preferably about 50% less than in the areas of the rows of stitches. In one embodiment, the microsponges formed have a width of about 2 to 20 millimeters.

Once the stitched nonwoven fabric is subjected to the collimated fluid, the fibers from the nonwoven base at least partially encapsulate the stitching fibers on both sides of the nonwoven fabric meaning that some of the fibers from the nonwoven base surround, cover, or otherwise cross over the stitches. FIG. 8 is a 30× magnification image of the top view of the stitched nonwoven fabric before impinging the fabric with the collimated stream. FIG. 13 is a 30× magnification image of the top view of the stitched nonwoven fabric after impinging the fabric with the collimated stream. As can be seen from FIG. 14, the fibers from the nonwoven base partially encapsulate the stitches in the fabric. This gives the fabric more of a woven-like appearance.

After the microsponges have been created by the collimated fluid treatment, the resultant fabric is removed from the porous substrate and may be heat set at about 300° F. to 375° F., preferably for at least 30 seconds, to ensure that the microsponge is permanent. Excessive heat setting may reduce softness and absorbency. Permanent in this context means that the microsponges retain at least 95% of other their original height after at least 10 industrial launderings.

In a preferred embodiment, the nonwoven base comprises between about 65% and 85% by weight a 2.25 denier, 4.0" PET staple fiber and about 15% and 35% by weight a 6 denier, 16 segment splittable fiber having a 10:90 to 50:50 ratio nylon to polyester. These fibers are laid, carded, and needled into a 4.0 to 6.0 oz/sq-yd nonwoven base. The nonwoven base is then stitched with a 1-0/1-0, 1-2/1-2 stitch at 10 gauge, 10 cpi (courses per inch) using a 150 denier spun or filament polyester yarn. The microsponges in the stitched nonwoven fabric are formed on a supporting member comprising ¼" diameter circular pores having a pore wall thickness (distance on the surface of the supporting member between the pores) of 4 mil (approximately 100 micrometers). The stitched nonwoven fabric is impinged on the first side by a collimated fluid comprising water jets spaced 40 per inch that are at a pressure of 1000-1300 psi emanating from slots that are 15 mil deep by 10 mil wide by 250 mil long and ½" from the stitched nonwoven fabric which is moving at a speed of about 30-60 yards per minute. The preferred heatsetting temperature is 320° F. with a dwell time of 30 seconds to 3 minutes.

In one embodiment, the outer edge region of the nonwoven fabric with microsponges is ultrasonically sealed and/or slit. The area of the fabric that is ultrasonically sealed may be the outer most edge of the towel or may be slightly in from the edge. The polymers used in one preferred embodiment of the nonwoven fabric with microsponges (polyester, polyester copolymers, and polyamides) are thermoplastics and ultrasonically fusible fibers, meaning that the fibers will melt when subjected to enough ultrasonic energy. Ultrasonic slitting and sealing uses acoustic energy to melt the fibers of the nonwoven towel together preventing fraying of the edges of the fabric. The vibrational energy of an ultrasonic horn is converted to heat due to intermolecular friction that melts and fuses the two parts. When the vibrations stop, the fabric solidifies joining the fibers together. With ultrasonic slitting, the fabric may be is cut and sealed in one step saving process steps and money. Ultrasonics can operate at relatively high speeds making it a quick processing step.

In one embodiment, the nonwoven fabric with microsponges comprises an antimicrobial treatment. This treatment may be applied during the manufacture of the fibers, applied to the fibers, or applied to the finished fabric. Antimicrobial chemistries that may be applied include, but are not limited to inorganic silver-based ion-exchange compounds (available as Alphasan® available from Milliken and Company), zeolite compounds, nanosilver, hindered amines, halamines, and zinc oxide. It is preferred to have an antimicrobial chemistry that is durable so that the towel maintains its antimicrobial characteristics through laundering and use.

The nonwoven fabric with microsponges preferably has an absorbency of aqueous solutions of at least 400% by weight of the fabric. Additionally, the fabric preferably has a Stoll flat abrasion results of greater than 500 cycles after 30 industrial washes as tested by ASTM D3886-99.

Preferably, the nonwoven fabric with microsponges has durability to commercial laundering. After 30 industrial washes, the fabric preferably has a tongue tear strength of at least 10 lb-f as tested by ASTM 2261 Additionally, the fabric preferably has a grab tensile strength of at least 50 lb-f as tested by ASTM D5034, and a sled friction of greater than 0.15 as tested by ASTM D1894 (friction is desired for picking up kitchen objects such as pots and pans) after 30 industrial washes.

In one embodiment, the nonwoven fabric with microsponges has a tongue tear of at least 10 lb-f in the warp and weft directions after being subjected to a chlorine test consisting of a series of 2 industrial washes and dryings and an overnight soaking in a 5% bleach solution repeated 5 times. Additionally, the fabric preferably has a tensile strength of at least 50 lb-f (pound force) in the warp and weft directions after the after the chlorine test. In one embodiment, the nonwoven fabric with microsponges has a bending stiffness of less than 1 lbf. A lower value indicates a more supple hand.

The nonwoven fabric with microsponges of the invention may be used as towels, sport towels, salon towels, automotive and transportation wash towels, retail bath towels, cabinet roll towels, barmops, restaurant cleaning towels, industrial and commercial cleaning towels, surgical towels, table skirting, table pads, pharmaceutical and chemical absorbents, and other durable cleaning applications.

EXAMPLES

Example 1

Example 1 was a nonwoven base formed from 65% weight of a 2.25 denier, 4.0" PET staple fiber and 35% by weight a 6 denier, 16 segment splittable fiber having a 46:54 ratio nylon to polyester. These fibers were laid, carded, and needled into a 5.5 oz/yd$^2$ nonwoven base. The cross-section is shown in FIG. 1.

Example 2

Example 2 was a stitched nonwoven fabric. The nonwoven base of Example 1 was stitched with a 150 denier filament polyester yarn in a stitching pattern of 1-0/1-0, 1-2/1-2 (as shown in FIG. 3) at 10 gauge, 10 cpi (courses per inch). The stitch shape factor for the stitch that was used is 0.75.

Example 3

Example 3 was an impinged nonwoven base. The nonwoven base of Example 1 was placed on a supporting member comprising ¼" diameter circular pores having a pore wall thickness of 4 mil (approximately 100 micrometers). The nonwoven base was impinged on a first side by room temperature water jets spaced 40 per inch at a pressure of 1200 psi emanating from slots that are 15 mil deep by 10 mil wide by 250 mil long. The water jets were approximately one half of an inch from the nonwoven base and angled at 0 degrees. This process was performed on single piece of the nonwoven base, but could have been performed in a continuous operation on a roll of nonwoven base. The impinged nonwoven base was then heatset at 320° F. for 30 seconds.

Example 4

Example 4 was an impinged, stitched nonwoven fabric with a stitch pattern exhibiting a stitch shape factor of 0.75 (shown in FIG. 3). The stitched nonwoven fabric of Example 2 was placed on a supporting member comprising ¼" diameter circular pores having a pore wall thickness of 4 mil (approximately 100 micrometers). The stitched nonwoven fabric was impinged on a first side by room temperature water jets spaced 40 per inch at a pressure of 1200 psi emanating from slots that are 15 mil deep by 10 mil wide by 250 mil long. The water jets were approximately one half of an inch from the stitched nonwoven fabric and angled at 0 degrees. This process was performed on single piece of the nonwoven base, but could have been performed in a continuous operation on a roll of nonwoven base. The impinged, stitched nonwoven fabric was then heatset at 320° F. for 30 seconds.

Example 5

Example 5 was an impinged, stitched nonwoven fabric with a stitch pattern exhibiting a stitch shape factor of 0.54. The nonwoven base of Example 1 was stitched with a 150 denier filament polyester yarn in a stitching pattern of 0-1/2-1 (as shown in FIG. 4) at 10 gauge, 10 cpi (courses per inch). The stitched nonwoven fabric was then placed on a supporting member comprising ¼" diameter circular pores having a pore wall thickness of 4 mil (approximately 100 micrometers). The stitched nonwoven fabric was impinged on a first side by room temperature water jets spaced 40 per inch at a pressure of 1200 psi emanating from slots that are 15 mil deep by 10 mil wide by 250 mil long. The water jets were approximately one half of an inch from the stitched nonwoven fabric and angled at 0 degrees. This process was performed on single piece of the nonwoven base, but could have been performed in a continuous operation on a roll of nonwoven base. The impinged, stitched nonwoven fabric was then heatset at 320° F. for 30 seconds.

Example 6

Example 6 was an impinged, stitched nonwoven fabric with a stitch pattern exhibiting a stitch shape factor of 0.54 and a gauge of 10. The nonwoven base of Example 1 was stitched with a 150 denier filament polyester yarn in a stitching pattern of 0-1/1-2, 2-3/2-1 (as shown in FIG. 7) at 10 gauge, 10 cpi (courses per inch). The stitch shape factor was used is 0.54. The stitched nonwoven fabric was then placed on a supporting member comprising ¼" diameter circular pores having a pore wall thickness of 4 mil (approximately 100 micrometers). The stitched nonwoven fabric was impinged on a first side by room temperature water jets spaced 40 per inch at a pressure of 1200 psi emanating from slots that are 15 mil deep by 10 mil wide by 250 mil long. The water jets were approximately one half of an inch from the stitched nonwoven fabric and angled at 0 degrees. This process was performed on single piece of the nonwoven base, but could have been performed in a continuous operation on a roll of nonwoven base. The impinged, stitched nonwoven fabric was then heatset at 320° F. for 30 seconds.

Example 7

Example 7 was a non heatset, impinged, stitched nonwoven fabric with a stitch pattern exhibiting a stitch shape factor of 0.75. Example 7 was processed at the same conditions as Example 4, but without the heat setting set.

Example 8

Example 8 was processed at the same conditions as example 3, but was not subjected to a heat setting operation.

Example 9

Example 9 was a commercially available cotton terry-cloth towel. The cotton terry cloth towel had a weight of approximately 32 oz and was a 100% cotton 20/2 open end ground and 20/2 open end pile, with a 9/1 open end filling.

The physical stitching and impinging characteristics of Examples 1-9 are summarized below in Tables 1-5. Table 2 shows the resultant stitch and pore characteristics of Examples 1-6

TABLE 2

Summary of stitch and supporting substrate parameters.

| Example | Width of Stitch | Stitch Shape Factor | Pore Size | Ratio of Stitch Pattern Width to Pore Size |
|---|---|---|---|---|
| 1 | N/A | N/A | N/A | N/A |
| 2 | 0.125 | 0.75 | N/A | N/A |
| 3 | N/A | N/A | 0.25 inch | N/A |
| 4 | 0.125 | 0.75 | 0.25 inch | 2:1 |
| 5 | 0.125 | 0.54 | 0.25 inch | 2:1 |
| 6 | 0.25 | 0.54 | 0.25 inch | 1:1 |

As can be seen in Table 2, Example 4 is the only example that satisfies the conditions necessary to creating microsponges.

Table 3 describes two additional characteristics of the formed fabrics. Percentage microsponge density is defined to be the percentage density of the area of the microsponge with the lowest density compared to the density of the towel in the areas of stitches. For example, if the microsponge had the same density as the areas under the stitches, the percentage microsponge density would be 100%. Also shown in the absorbance of the microsponge in terms of the percentage of weight of water calculated as a percentage of fabric weight.

TABLE 3

Summary of Change in Density between microsponge areas and non-microsponge areas and absorbance pf the formed fabric

| Example | % Microsponge Density (%) | Absorbance (% of fabric wt.) |
|---|---|---|
| 1 | N/A | 333% |
| 2 | N/A | 284% |
| 3 | ~100% | 368% |
| 4 | 49.8% | 654% |
| 5 | 25.4% | 481% |
| 6 | ~100% | 455% |

As can be seen from Table 3, example 4 absorbs substantially more water per fabric weight (654%) than any of the other examples listed in Examples 1-6. The non-impinged nonwoven base does not increase in absorbency after being impinged as can be seen by the absorbency of Example 1 of 333% as compared to the absorbency of Example 3 of 368%. The absorbency of Example 2 decreases to a level that is below the absorbency of Example 1 due to the presence of the stitches without the presence of microsponges. The absorbency and the percent microsponge density to non microsponge density of Example 5 is lower than the absorbency and the percent microsponge density to non microsponge density of example 4 because a stitch was used with a stitch shape factor of less than 0.55. The absorbency of Example 6 is less than the absorbency of Example 4 because a stitch was used with a stitch shape factor of less than 0.55. The percent microsponge density to non microsponge density of Example 6 decreased to a level below that exhibited by Example 5 because a stitch to pore ratio was outside the microsponge formation range.

Table 4 shows the "wringability" of Examples 2, 9, & 4. Wringability is quantified by the percent water (by fabric weight) that remains in the fabric after the fabric experiences a standard load to remove the water absorbed into the fabric.

TABLE 4

Summary of wringability differences
Wringability

| Towel Description | % Wt Water After Wringing |
|---|---|
| Example 9 | 120 |
| Example 2 | 201 |
| Example 4 | 125 |

Examples 4 and 9 have essentially the same wringability with the Example 2 having much poorer wringability.

Examples 3, 4, 7, & 8 were subjected to 5 industrial washing & drying cycles. After each wash & dry, the length of each sample was measured in the warp and fill direction. The percentage shrinkage from the unwashed & undried sample was then calculated.

TABLE 5

Summary of shrinkage differences
Effect of Stitching & Heatsetting on Towel Shrinkage
(% Change in Length)

| | # of Washes | | | | | | | | | |
|---|---|---|---|---|---|---|---|---|---|---|
| | 1 | | 2 | | 3 | | 4 | | 5 | |
| | Direction | | | | | | | | | |
| | Warp | Fill | Warp | Fill | Warp | Fill | Warp | Fill | Warp | Fill |
| Ex. 7 | −10.7 | −2.3 | −12.7 | −3.1 | −12.8 | −3.2 | −15.4 | −4.5 | −17.3 | −6 |
| Ex. 4 | −4 | −1.9 | −5.3 | −2.6 | −5.2 | −2.6 | −5.6 | −3.3 | −6.4 | −3.4 |
| Ex. 3 | −4.3 | −4.3 | −5.8 | −6.8 | −5.9 | −7.1 | −7.1 | −8 | −8.8 | −9.4 |
| Ex. 8 | −8.5 | −7.1 | −9.1 | −9.8 | −10.2 | −9.8 | −12.2 | −10.6 | −14.3 | −12.9 |

The Example 4 and Example 7 fabrics were processed with the same conditions except that Example 4 was subjected to a heatsetting process. The non-heat set fabric of Example 7 shrank more than the heatset fabric of Example 4. The Example 3 and Example 8 fabrics were processed with the same conditions except that Example 3 was subjected to a heat setting process. The non-heat set fabric of example 8 shrank more than the heatset fabric of example 3. In comparing the impinged, heatset, stitched nonwoven fabric of Example 4 to the impinged, heatset, non-stitched nonwoven fabric of Example 3, Table 4 shows that the non-stitched fabric shrank more than the stitched fabric. In comparing the impinged, non-heatset, stitched nonwoven fabric of Example 7 to the impinged, non-heatset, non-stitched non woven fabric of Example 8, Table 4 shows that the non-stitched fabric of Example 7 shrank more than the stitched fabric of Example 8.

Examples 4 and 9 were then tested for durability. Table 6 shows a summary of the data where the shrinkage of the stitched, impinged, heatset nonwoven fabric of Example 4 was compared to the shrinkage of the cotton terry towel of Example 9 to determine durability. Both samples were exposed to 50 industrial wash and dry processes. The length of each sample was measured in the warp and fill directions after 5, 10, 20, 30, 40, and 50 wash & dry processes and tabulated below in terms of percent shrinkage from the measured lengths in the warp and fill directions of samples exposed to no wash and dry processes.

TABLE 6

Summary of durability of Examples 5 and 9
Durability of Present Invention compared to Prior Art
(% Change Length)

| | | Example 9 | Example 4 |
|---|---|---|---|
| Wash #5 | Warp | −13.3 | −7.4 |
| | Fill | −8.7 | −1.5 |
| Wash #10 | Warp | −14.6 | −8.5 |
| | Fill | −9.6 | −2.2 |
| Wash #20 | Warp | −15.6 | −9.7 |
| | Fill | −9.8 | −3.8 |
| Wash #30 | Warp | −1.9 | −9.9 |
| | Fill | −10.1 | −3 |
| Wash #40 | Warp | −16 | −9.9 |
| | Fill | −9.7 | −2.6 |
| Wash #50 | Warp | −15.6 | −10.3 |
| | Fill | −8.9 | −3.2 |

Table 6 shows that the impinged, stitched, heatset nonwoven fabric of the present invention shrinks less than the cotton terry towel.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the invention.

What is claimed is:

1. A process of forming a nonwoven fabric with microsponges comprising:

obtaining a nonwoven base comprising fibers having a first side and a second side and having a weight of greater than about 2 oz/yd$^2$;

stitching the nonwoven base with a stitching yarn in elongated spaced apart rows of stitches to form a stitched nonwoven fabric, the rows of stitching having a stitch shape factor greater than 0.54, wherein the stitching yam has a tenacity greater than 1 gf/denier;

forming a plurality of microsponges by impinging the first side of the stitched nonwoven fabric with a collimated fluid stream with from about 100 to 200 joules per gram while supporting the stitched nonwoven fabric on a supporting member having areas impervious to the collimated fluid and pores in the supporting member which are pervious to the collimated fluid, and;

wherein the pores of the supporting member have a pore shape factor that is at least as great as the value of the stitch shape factor of the rows of stitches and the ratio of the distance between the rows of stitches to the average width of the pores is from about 3:2 to 5:2.

2. The process of claim 1, wherein the rows of stitches extend generally in a lengthwise direction of the nonwoven base.

3. The process of claim 1, wherein the nonwoven base fibers comprise synthetic fibers.

4. The process of claim 1, wherein the nonwoven base fibers comprise staple fibers.

5. The process of claim 4, wherein the nonwoven base fibers comprise splittable fibers.

6. The process of claim 1, further comprising heat selling the nonwoven fabric with microsponges.

7. The process of claim 1, wherein the collimated fluid is water.

8. The process of claim 7, wherein the collimated fluid comprises a hydrophilic lubricant.

9. The process of claim 1, wherein the pores of the supporting member have a width of between about 2 and 10 millimeters.

10. The process of claim 1, wherein the ratio of the distance between the rows of stitches to the average width of the pores is about 2:1.

11. The process of claim 1, wherein the density of the nonwoven base is between about 10 and 90 percent lower at the midpoint between the rows of stitches compared to the rows of stitches.

* * * * *

UNITED STATES PATENT AND TRADEMARK OFFICE

CERTIFICATE OF CORRECTION

PATENT NO. : 7,426,776 B2
APPLICATION NO. : 11/703378
DATED : September 23, 2008
INVENTOR(S) : Love, III et al.

It is certified that error appears in the above-identified patent and that said Letters Patent is hereby corrected as shown below:

In column 16, line 40, claim 1, after the word "stitching" delete the word "yam" and replace with --yarn--.

In column 16, line 64, claim 6, after the word "heat" delete the word "selling" and replace with the word --setting--.

Signed and Sealed this

Eighteenth Day of November, 2008

JON W. DUDAS
*Director of the United States Patent and Trademark Office*